US005286218A

United States Patent [19]

Sakurai et al.

[11] Patent Number: 5,286,218

[45] Date of Patent: Feb. 15, 1994

[54] ELECTRIC CONNECTOR HAVING MEANS FOR FIXING CONTACTS

[75] Inventors: Haruo Sakurai, Machida; Choshiro Iida, Tendo; Kei Tohyama, Tendo; Kazuhito Takemura, Tendo, all of Japan

[73] Assignee: Minnesota Mining and Manufacturing Company, St. Paul, Minn.

[21] Appl. No.: 986,133

[22] Filed: Dec. 4, 1992

[30] Foreign Application Priority Data

Dec. 27, 1991 [JP] Japan ..... 3-346992

[51] Int. Cl.[5] ..... H01R 4/24

[52] U.S. Cl. ..... 439/444

[58] Field of Search ..... 439/444, 733, 741, 752, 439/389–425

[56] References Cited

U.S. PATENT DOCUMENTS

| | | | |
|---|---|---|---|
| 3,761,869 | 9/1973 | Hardesty et al. | 439/444 |
| 3,930,708 | 1/1976 | Wedekind et al. | 339/99 |
| 3,945,705 | 3/1976 | Seim et al. | 339/98 |
| 4,230,391 | 10/1980 | Keglewitsch | 439/395 |
| 4,470,655 | 9/1984 | Kalka et al. | 439/404 |
| 4,484,791 | 11/1984 | Johnson | 439/404 |
| 4,682,835 | 7/1987 | Aujla et al. | 439/395 |

*Primary Examiner*—Joseph H. McGlynn

*Attorney, Agent, or Firm*—Gary L. Griswold; Walter N. Kirn; John C. Barnes

[57] ABSTRACT

A connector formed of two molded parts and a plurality of contacts is provided with means for fixing the contacts such that a plurality of contacts are fixed accurately and rigidly to the body of a connector with a simple construction.

2 Claims, 5 Drawing Sheets

ELECTRIC CONNECTOR HAVING MEANS FOR FIXING CONTACTS

BACKGROUND OF THE INVENTION

The present invention relates to a connector structure for forming an electrical connection, and more particularly to an improvement for a connector structure having a means for fixing contacts capable of precisely positioning and fixing a plurality of contacts upon assembling the contacts to a connector body.

DESCRIPTION OF THE PRIOR ART

Contacts for a connector must be precisely positioned on a connector body to avoid electrical defects such as shorting, erroneous connection, disconnection and so forth. Namely, a plurality of contacts are fixed at accurate positions according to a predetermined mutual interval and necessary connecting length, and prevented from shifting the positions thereafter. For this, there are known connectors provided with an array-plate for arranging a plurality of contacts at predetermined positions, and a plurality of engaging projections formed on respective contacts for engaging with the array-plate and the connector body, in which the array-plate is fitted with the body after fixing the contacts onto the array-plate. One example of such a prior art connector is shown in FIGS. 5 and 6.

The prior art connector, shown in FIGS. 5 and 6, comprises a plurality of contacts 1, an array-plate 2 supporting the contacts 1 with given intervals, and a body 3 for supporting the array-plate 2 and fixing a plurality of contacts 1 at predetermined positions to engage with the counterpart connector. A plurality of contacts 1 are respectively independent pin-shaped electrical conductors and each has a connecting section 1*a* formed at one end for slidingly connecting with the contact of the counterpart connector, a U-shaped terminating section 1*b* formed at the other end for terminating with a cable; and a first press-fit area or section 4 and a second press-fit area or section 5 formed therebetween. The first and second press-fit sections 4 and 5 comprise saw-tooth shaped projections extending transverse with respect to the contact 1. The first press-fit section 4 is adapted to engage with the body 3 and the second press-fit section 5 is adapted to engage with the array-plate 2. The array-plate 2 is formed of an insulative resin molding product and defines a plurality of support-holes 6 arranged at predetermined positions on the rectangular major surface and extending therethrough in the thickness direction, so as to support the contacts 1 with given intervals. As shown by a dashed line, the support-holes 6 have a simple rectangular parallelepiped configuration. The second press-fit section 5 of the contact 1 engages the side walls of the support-hole 6. The body 3 is formed of an insulative resin molding product similar to the array-plate 2, and has a holding part 3*a* for holding the array-plate 2 which, in turn, supports the contacts 1, and a fitting part 3*b* for guiding the counterpart connector and engaging therewith. As shown in FIG. 6, a wall part 3*c* is formed between the holding part 3*a* and the fitting part 3*b* and extending inside of the body 3. A plurality of openings or fix-holes 7 for fixing a plurality of contacts 1 extend in the direction of the wall part 3*c*. The press-fit section 4 of the contact 1 engages with the side walls of the fix-hole 7. The fitting part 3*b* is formed into a recessed configuration for receiving the contacts of the counterpart connector. Through the upper and lower wall section of the recess, a plurality of grooves 8 are formed for guiding a plurality of contacts 1 extending from respective fix-holes 7.

In the construction set forth above, at first, a plurality of contacts 1 are inserted into respective support-holes 6 of the array-plate 2 and engage the second press-fit section 5 with the side walls of the support-holes 6. At this time, the overall width of the second press-fit section 5 is designed to be slightly wider than the width of the support-holes 6. Accordingly, by pressing the contacts 1 into the support-holes 6 with a predetermined pressure, the second press-fit sections 5 engage with the side walls of the support-holes 6. The array-plate 2 with a plurality of contacts 1 thus fixed at predetermined positions is inserted into the holding part 3*a* of the body 3. At the same time, respective contacts 1 are inserted into the fix-holes 7 in the wall part 3*c* and advanced along the grooves 8 on the fitting part 3*b*. Simultaneously with completion of insertion of the array-plate 2 and latching the same within the holding part 3*a* by latching means not shown, the first press-fit sections 4 of respective contacts 1 engage with the side walls of the fix-holes 7. Similarly, the first press-fit section 4 of the contact 1 has an overall width slightly wider than the width of the fix-hole 7. Accordingly, by providing a predetermined pressure in the directions approaching each other for the array-plate 2 and the body 3 to press-fit the contacts 1 with the fix-holes 7, the first press-fit section 4 is engaged to the side walls and respective contacts 1 are thus fixed at the predetermined positions of the body 3.

In the above-mentioned prior art connector, two press-fit sections 4 and 5 provided for the contacts 1 are press-fitted respectively to the array-plate 2 and the body 3, so that the contacts 1 are fixed in the body 3. Accordingly, from the view point of assembling procedure, the holding force (or pressure required for press-fitting) for respective contacts 1 in the array-plate 2 has to be sufficiently greater than that in the body 3. Namely, it becomes necessary to provide a greater dimensional difference between the overall width of the second press-fit section 5 and the support-hole 6 than that between the overall width of the first press-fit section 4 and the fix-hole 7 so as to prevent the contacts 1 from causing longitudinal displacement with the support-holes 6 by the press-fitting pressure of the contacts 1 to the fix-holes 7 upon assembling of the array-plate 2 onto the body 3. However, such precise setting can be easily fluctuated because of a tolerance in the formation of the array-plate 2 and the body 3. Accordingly, for assuring fixing of the contacts 1, high dimensional precision is required, thereby resulting in an increase in the production cost. On the other hand, after assembling the connector as set forth above, upon terminating the cable to the U-shaped terminating section 1*b* of the contact 1, the holding force for fixedly holding the contact 1 resisting against the press-fitting pressure depends on the interengagement force between the second press-fit section 5 of the contact 1 and the support-hole 6 of the array-plate 2, so the force is insufficient. Furthermore, since the engagement between the second press-fit section 5 and the support-hole 6 is obtained by intrusion of the projections of the second press-fit section 5 into the side walls of the support-hole 6, small clearance can be left between the side surface of the contact 1 and the wall surfaces of the support-hole 6, so that a certain fixing force against the external force in the lateral direction cannot be obtained. This is also true in the relationship between the first press-fit section 4 and the fix-hole 7.

As set forth above, the prior art connector has a structure such that the contacts, which are originally firmly fixed to the connector body, are fixed relative to the array-plate. In addition, since the holding with the array-plate is insufficient as set forth above, the conventional connector has a problem of low reliability in relative position between the body and the contacts upon assembling or upon connection with the counterpart connector.

The present invention provides substantial improvement for solving these problems. Therefore, the purpose of the present invention is to provide a connector that has a novel means for fixing the contacts, which can fix a plurality of contacts in an accurate position relative to the connector body with a very simple construction.

SUMMARY OF THE INVENTION

In order to achieve the above-mentioned purpose, the present invention provides an electrical connector comprising a plurality of contacts having at one end a connecting end for making connection to another electronic component and at the other end a terminating end for terminating with an electric cable; an array-plate having a plurality of support holes supporting the contacts at predetermined positions in an array and made through a thickness of the array-plate, a body including a holding part for receiving and holding the array-plate, a fitting part defining a cavity for receiving another electronic component, and a wall part arranged between the holding part and the fitting part and having a plurality of openings to receive the contacts; and means for fixing each of the contacts at predetermined positions in the body, the improvement being in the array-plate in that it has an abutting surface for abutting the wall part within the holding part, and the means for fixing each of the contacts comprise a press fit area consisting of projections provided on each of the contacts so as to define a wide portion slightly wider than a width of the openings of the wall part, and engaged with the wall part by press-fitting the contacts into the openings with a certain pressure; and that depressions are provided at an outer periphery of each of the support holes of the array-plate in the abutting surface to receive protrusions provided on each of said contacts at a certain position between the press-fit area and the terminating end so the protrusions fit within the depressions.

According to the preferred embodiment, the means for fixing the contacts further comprise a second press-fit area consisting of projections provided on each of the contacts at a position between the protrusions and the terminating end so as to define a wide portion slightly wider than a width of the support holes of the array-plate, and which are engaged with the array-plate by press fitting the contacts into the support-holes with a certain pressure for holding the array-plate in the holding part.

Upon fixing a plurality of contacts to the body, the terminating end of the contacts are, at first, inserted into a plurality of support-holes in the array-plate. Once the insertion is completed, protrusions provided for each contact are firmly received within depressions formed on the outer periphery of the support hole. An assembly of the contacts and the array-plate thus obtained is engaged to a holding part of the body and is held therein. At this time, the press-fit area of each contact is press-fitted into the opening in the wall part of the body whereby a plurality of contacts are engaged to the body. The protrusions of the contacts and the depressions of the array-plate cooperate with each other to prevent the contacts from causing displacement in a longitudinal direction relative to the pressing force exerted on the contacts upon press-fitting. At the same time, the displacement of the contacts in the lateral direction can also be prevented by firm engagement between the protrusions and the depressions. On the other hand, by abutting the abutting surface of the array-plate onto the wall part of the body, the protrusions also contact with the wall part so that displacement of the contact in the longitudinal direction can be prevented even when the pressure is exerted on the contacts upon terminating the cable to the terminating end of the contacts.

BRIEF DESCRIPTION OF THE DRAWING

The present invention will be discussed hereafter in more detail in terms of an embodiment with reference to the accompanying drawings, wherein.

DETAILED DESCRIPTION OF THE INVENTION

Figure 1:
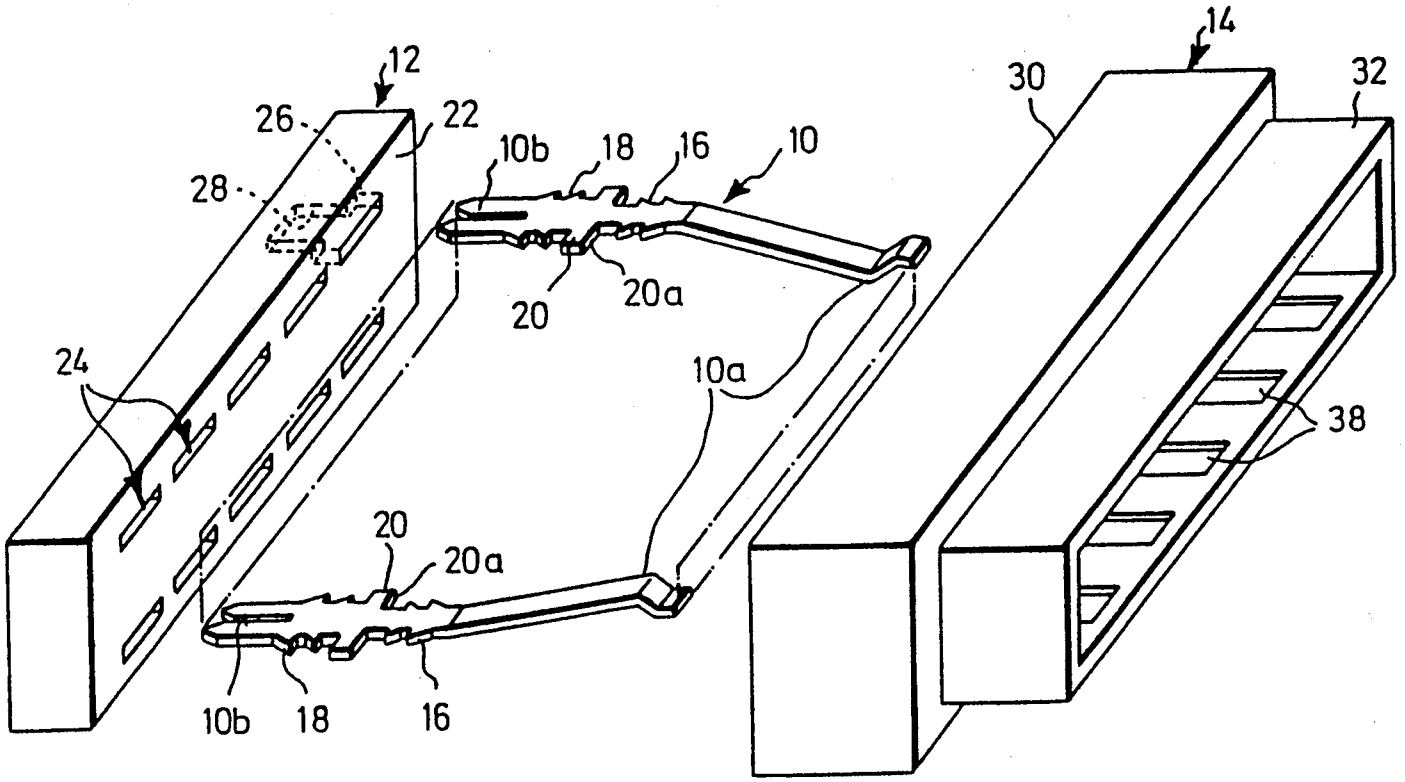
FIG. 1 is an exploded perspective view of one embodiment of a connector according to the invention.
Figure 5:
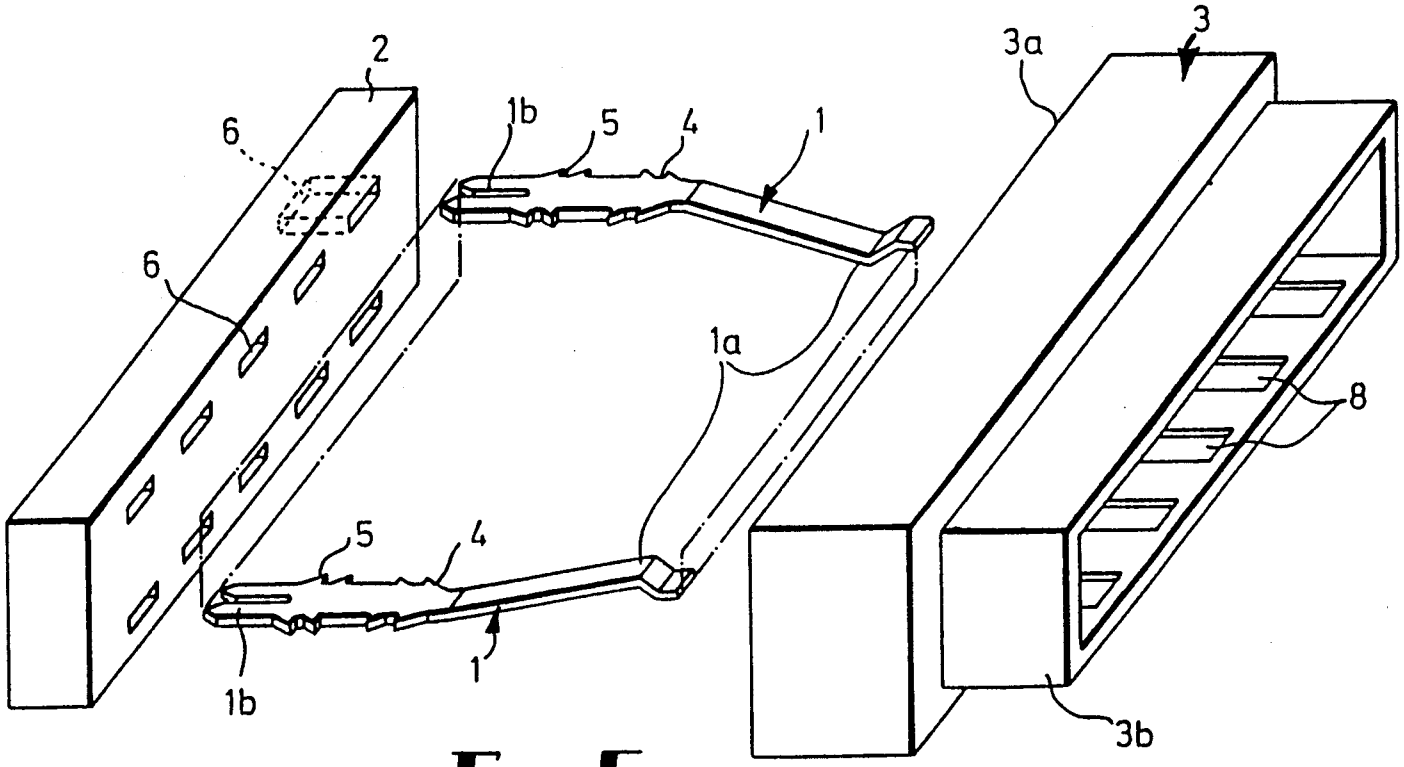
FIG. 5 is an exploded perspective view of the conventional connector.
Figure 6:
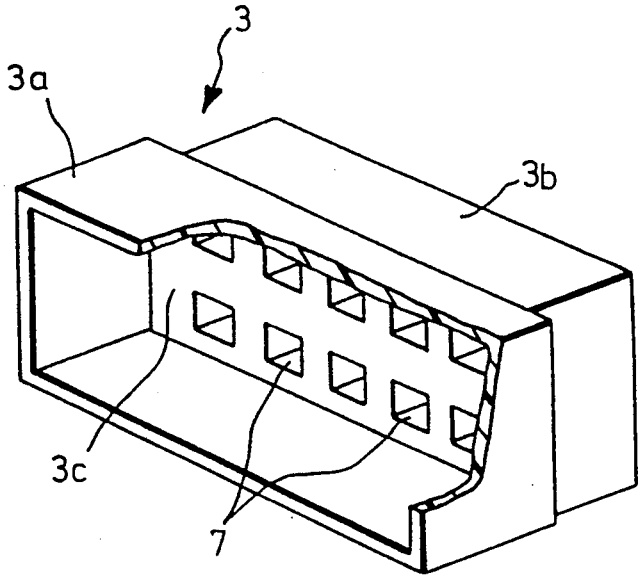
FIG. 6 is a partially cut-out perspective view showing the back side of the body of the conventional connector.

Referring to FIG. 1, there is illustrated an exploded view of one embodiment of a connector according to the present invention. The connector shown in FIG. 1 comprises a plurality of contacts 10, an array-plate 12 supporting these contacts in predetermined intervals, and a body 14 for fixedly arranging a plurality of contacts 10 in predetermined positions and in engagement with a counterpart connector, similar to the conventional connector of FIG. 5. A plurality of contacts 10 are respective independent pin-shaped electric conductors, each of which has a connecting end 10*a* formed on one end for slidingly connecting with another contact of the counterpart connector, a U-shaped terminating end 10*b* formed on the other end for terminating with a cable, and a first press-fit area 16 and a second press-fit area 18 both formed therebetween. The first press-fit area 16 and the second press-fit area 18 respectively comprise saw-tooth shaped projections projecting laterally with respect to the contact 10. The first press-fit area 16 engages with the body 14 and the second press-fit area 18 engages with the array-plate 12, respectively.

The contact 10 of the connector of this embodiment also has protrusions 20 protruding from each side of the contact 10 between the first press-fit area 16 and the second press-fit area 18. The protrusions 20 form one component of means for fixing the contacts in the connector, and cooperate with a support hole or depression of the array-plate 12, which will be discussed later, to support the contact 10 at the predetermined position.

Figure 2:
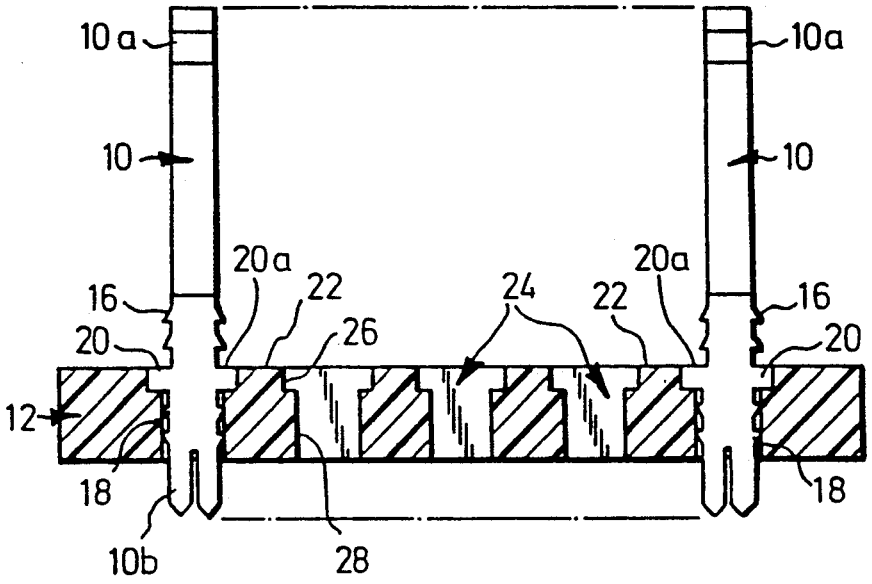
FIG. 2 is a cross section of an assembly of contacts and an array-plate in the connector of FIG. 1.
Figure 3:
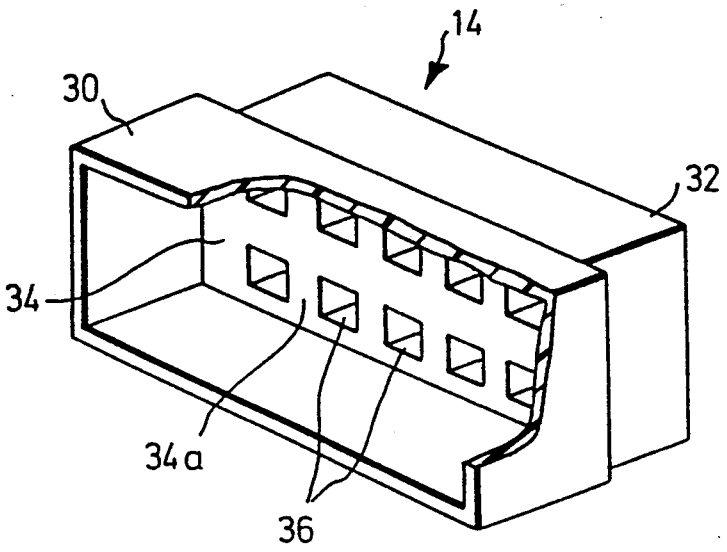
FIG. 3 is a partially cut-out perspective view showing back side of the body of connector of FIG. 1.

The array-plate 12 is formed as an insulative resin molded product and has a plurality of support holes 24 arranged in predetermined positions on a rectangular abutting surface 22 and extending in the direction of thickness of the array-plate. The abutting surface 22 is adapted to contact with a wall part of the body, which will be discussed later. The support hole 24 is formed as a stepped hole having T-shaped cross section, and has a wider portion adjacent to the abutting surface 22. Depressions 26 form the wider portion of the stepped hole and have substantially the same configuration as the protrusions 20 of the contact 10. Namely, the dimensions of the depressions 26 and the protrusions 20 are substantially the same. On the other hand, the narrower portion 28 has a width slightly smaller than the overall width of the second press-fit area 18 similar to the prior art connector. Accordingly, upon inserting the contact 10 into the support hole 24, the second press-fit area 18 is press-fitted into the narrower portion 28 of the support hole 24 with a predetermined pressure in the same manner as the prior art. As shown in FIG. 2, when the contact 10 reaches a given position within the support hole 24 and the narrower portion 28, the protrusions 20 are placed in a position engaging with the depressions 26. At this time, since the dimensions of the protrusions 20 and the depressions 26 have substantially the same dimensions, the protrusions 20 are firmly received within the depressions 26 without forming clearance therebetween. Then, the shoulders 20*a* of the protrusions 20 adjacent to the first press-fit area 16 are arranged on the same plane as the abutting surface 22 of the array-plate 12.

The body 14 is formed as an insulative resin molded product similar to the array-plate 12, and has a holding part 30 for holding the array-plate 12 which, in turn, supports the contacts 10, and a fitting part 32 to engage with the counterpart (not shown). Between the holding part 30 and the fitting part 32, a wall part 34 is formed on the inside of the body 14. The wall part 34 is provided with a plurality of openings or fix holes 36 extending in the thickness direction for fixing the contacts 10. The first press-fit area 16 of the contact 10 engages with the side walls of the fix hole 36. The surface 34*a* of the wall part 34 adjacent to the holding part 30 is formed as a flat plane so that it may establish firm contact with the abutting surface 22 of the array-plate 12 upon completion of engagement of the array-plate 12. The fitting part 32 defines a cavity for receiving another contact of the counterpart connector. A plurality of grooves 38 for guiding a plurality of contacts 10 extending through the fix holes 36 are formed at upper and lower walls of the fitting part 32. The width of the fix hole 36 is slightly smaller than the overall width of the first press-fit area 16 similar to the prior art. In addition, the width of the groove 38 is slightly greater than the overall width of the connecting end 10*a* of the contact 10. Therefore, the body 14 has substantially a construction identical to that of the body 3 of the prior art connector.

Figure 4:
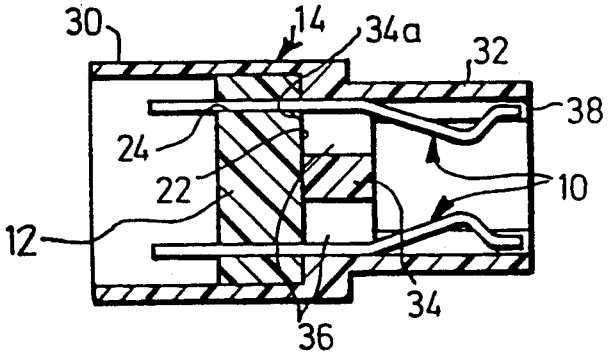
FIG. 4 is a longitudinal section of an assembly of connector of FIG. 1.

In the construction set forth above, at first, a plurality of contacts 10 are press fitted into the respective support holes 24 of the array-plate 12 so that the protrusions 20 and the depressions 26 cooperate to fixedly support respective contacts 10 at predetermined positions. Then, the assembly of the contacts 10 and the array-plate 12 is inserted into the holding part 30 of the body 14 with the predetermined pressure. At this time, each contact 10 is press-fitted with the fix hole 36 of the wall part 34 according to the above-mentioned dimensional relationship, and is advanced along the groove 38 of the fitting part 32. Once the insertion of the array-plate 12 is completed, the array-plate is latched within the holding part 30 by means of a latching means (not shown), the first press-fit area 16 of the contact 10 is simultaneously engaged onto the side walls of the fix hole 36. By this, each contact 10 is fixed to the predetermined position on the body 14 (see FIG. 4).

In this assembling process, it is not necessary to accurately adjust the holding force, or pressure required for press-fitting, for each contact 10 with respect to each of the array-plate 12 and the body 14, any more. Namely, the dimensional difference between the overall width of the second press-fit area 18 and the width of the support hole 24 can be smaller than the dimensional difference between the overall width of the first press-fit area 16 and the width of the fix hole 36. This is because, by close engagement between the protrusions 20 of the contact 10 and the depressions 26 of the support hole 24, displacement of the contact 10 in the longitudinal direction in the support hole 24 will never be caused even when the press-fitting force to the fix hole 36 acts on the contact 10 in the opposite direction upon assembling the array-plate 12 to the body 14. Furthermore, upon terminating the cable to the U-shaped terminating end 10*b* of the contact after completing assembly of the connector as set forth above, displacement of the contact 10 in the longitudinal direction is avoided with respect to the terminating force by abutment of the shoulders 20*a* of the protrusions 20 of the contact 10 and the surface 34*a* of the wall part 34 of the body 14. In addition, respective engagements of the first press-fit area 16 with the fix hole 36 and the second press-fit area 18 with the support hole 24 are established by intrusion of the projections of the press-fit areas 16, 18 into the side walls of respective holes 36, 24 in the same manner as the prior art, and thus small clearances are left between the side surfaces of the contact 10 and the side walls of respective holes 36, 24. However, with the firm engagement between the protrusions 20 of the contact 10 and the depressions 26 of the support hole 24, the contact 10 can be fixed with the external force in the lateral direction.

As set forth above, in this embodiment of the connector, the contact 10 will never be displaced in the longitudinal direction upon engaging the array-plate 12 to the body 14, and the first press-fit area 16 of the contact 10 can be firmly fixed in the fix hole 36 of the body 14. Accordingly, a plurality of contacts 10 can be firmly fixed to the body 14 of the connector accurately. The fixing force is strong both in the longitudinal direction and the lateral direction of the contact 10 so that the contact can be firmly held at the predetermined positions upon assembly, terminating the cable, and connecting the counterpart connector.

Furthermore, the second press-fit area 18 of the contact 10 in the above-discussed embodiment is not an essential feature of the present invention. In the present invention, the array-plate is only required to align a plurality of contacts at predetermined positions, and subsequent fixing of the contact is achieved by the means for fixing the contacts constituted of the wall part of the body having the fix hole, the press-fit area of the contact to be press-fitted into the fix holes (the first press-fit area 16 in the above-mentioned embodiment), and the protrusions on the contact and the depressions of the support hole in the array-plate.

It should be noted that although the protrusions 20 of the contact 10 and the depressions 26 of the array-plate 12 are formed into a rectangular configuration in the above-mentioned embodiment, the configuration is not specified and can be of any configuration as long as displacement of the contact can be successfully prevented. Furthermore, the arrangement of the protrusions 20 and the depressions 26 can be shifted in the circumferential direction from the shown positions.

As is clear from the above description, according to the present invention, the means for fixing the plurality of contacts to respective predetermined positions of the body, is constructed with the press-fit area formed in each contact for engagement with the wall part by press-fitting the contact into the opening of the wall part of the body with a predetermined pressure, the depressions formed on the outer periphery of each of the support holes formed in the array-plate and extending from the abutting surface of the array-plate, and protrusions formed on the predetermined position adjacent to the terminating end relative to the press-fit area of the contacts, and longitudinal and lateral displacement of the contact is prevented by cooperation of the protrusions of the contact and the depressions of the array-plate so that the connector, which can fix the contacts at predetermined positions in the body at any occasion of assembling the connector and terminate the cable, and connect with another connector, can be provided. Accordingly, it is advantageous in that it improves reliability of the connector and lowers production cost.

The connector includes a plurality of contacts 10, an array-plate 12 having a plurality of support holes 24 for supporting the contacts 10 at predetermined positions, and a body 14 for folding the array-plate 12 supporting the contacts 10. The body 14 includes a wall part 34 on which a plurality of fix holes 36 are formed for fixing a plurality of contacts 10 at the predetermined positions. The array-plate 12 includes an abutting surface 22 adapted to be in contact with the wall part 34. The contact 10 has a press-fit area 16 formed to have a greater width than the width of the fix hole 36. Depressions 26 extend from the abutting surface 22 on the outer periphery of the support hole 24. Protrusions 20 having substantially the same dimension as the depressions 26 are formed on the contact 10.

We claim:

1. An electrical connector comprising an array-plate having a plurality of support holes extending through the array plate from an abutting surface through the thickness thereof and arranged in an array at predetermined positions, said array plate having depressions at the outer periphery of each of said support holes adjacent said abutting surface;

a body including a holding part for receiving and holding the array-plate, a fitting part defining a cavity for receiving another electronic component, and a wall part arranged between the holding part and the fitting part and having a plurality of fix openings; and a plurality of contacts having at one end a connecting end extending through said fix openings into said fitting part for making connection to another electronic component and at the other end a terminating end for terminating with an electric cable, protrusions on each of said contacts positioned between said connecting end and said terminating end and having substantially the same dimensions as said depressions of said array plate so as to just fit within said depressions under pressure, and a press-fit area consisting of projections provided on said contacts between said protrusions and said connecting end so as to define a wide portion slightly wider than a width of said fix openings of said wall part and engaged with said wall part by press fitting said contacts into said fix openings.

2. An electric connector as claimed in claim 1 in which said contacts further comprise a second press-fit area consisting of projections provided on each of said contacts at a position between said protrusions and said terminating end so as to define a wide portion slightly wider than a width of said support-holes of said array-plate, and engaged with said array-plate by press-fitting said contacts into said support-holes with a certain pressure for holding said array-plate in said holding part.

* * * * *